US005461746A

United States Patent [19]

Banik et al.

[11] Patent Number: 5,461,746

[45] Date of Patent: Oct. 31, 1995

[54] MAGNETIC CLEANING PIG

[75] Inventors: Niranjan Banik, Tulsa; Harry M. Land, Owasso; Edward W. Levy, Jennings, all of Okla.

[73] Assignee: TDW Delaware, Inc., Wilmington, Del.

[21] Appl. No.: 373,554

[22] Filed: Jan. 17, 1995

[51] Int. Cl.[6] ..... B08B 9/04

[52] U.S. Cl. ..... 15/104.061; 209/215

[58] Field of Search ..... 15/104.061, 104.062, 15/104.063; 209/215

[56] References Cited

U.S. PATENT DOCUMENTS

| | | | |
|---|---|---|---|
| 3,292,197 | 12/1966 | Stephens | 15/104.061 |
| 3,546,642 | 12/1970 | Frederick et al. | 335/305 |
| 3,673,629 | 7/1972 | Casey et al. | 15/104.061 |
| 3,850,811 | 11/1974 | Wheelock | 210/223 |
| 4,077,080 | 3/1978 | Ross | 15/104.061 |
| 4,113,611 | 9/1978 | Gohm | 209/215 |
| 4,345,350 | 8/1982 | Burd | 15/104.061 |
| 4,767,603 | 8/1988 | Byrd et al. | 422/134 |
| 4,907,314 | 3/1990 | Kershaw | 15/104.061 |
| 4,945,306 | 7/1990 | Lowther | 324/220 |
| 5,035,021 | 7/1991 | LeDevehat | 15/104.061 |
| 5,127,125 | 7/1992 | Skibowski | 15/104.061 |

FOREIGN PATENT DOCUMENTS

| | | | |
|---|---|---|---|
| 3122643A1 | 1/1983 | Germany . | |
| 1417943 | 8/1988 | U.S.S.R. | 15/104.061 |

*Primary Examiner*—Edward L. Roberts, Jr.
*Attorney, Agent, or Firm*—Head and Johnson

[57] ABSTRACT

A magnetic disc for a cleaning device which is passed through a pipeline having a cylindrical internal wall. The magnetic disc includes a flexible circular disc body perpendicular to the cylindrical wall, the disc body having a plurality of radially spaced openings therethrough. A magnet is installed in each opening in the disc body, each magnet having poles oriented axially with the cylindrical wall. A pair of opposed retainer plates for each magnet are fastened to the disc body to retain the magnet in the disc body and to extend the magnetic field of action.

13 Claims, 4 Drawing Sheets

MAGNETIC CLEANING PIG

BACKGROUND OF THE INVENTION

1. Field of the Invention.

The present invention relates to a magnetic cleaning device which is passed through a pipeline to remove ferromagnetic debris.

2. Prior Art.

Pipelines for fluid transportation make use of pipeline equipment that is passed into and through the pipeline. The equipment may be spherical or cylindrical and may be pulled, pushed or forced through the pipeline. A spherical example is illustrated in Frederick, et al. (U.S. Pat. No. 3,546,642). The pipeline equipment may be used for gauging or inspecting the inside wall of the pipeline or for separating various fluids. In one type of pipeline pig, flexible cups are mounted on a central shaft, mandrel, or pig body with the edges of the cups engaging the internal wall of the pipeline.

Pipeline equipment for cleaning the interior of the pipeline loosens and removes material that has been deposited or that has developed. Examples of pipeline debris are rust, scale and welding rods, slag and petroleum sludge. In one type of pipeline cleaning pig, brushes engage the internal wall of the pipeline. In another type of cleaning pig, scrapers engage the internal wall of the pipeline. A magnet or magnets are used to attract ferromagnetic debris to the cleaning device and remove ferromagnetic debris from inside the pipeline. An example of this type is seen in Stephens (U.S. Pat. No. 3,292,197).

It is also known that pipeline inspection equipment utilizes magnets to produce a magnetic field. The change in the magnetic field indicates an event or anomaly to be detected. The anomaly detection is effected by the presence of magnetic debris in the line.

It is, therefore, desirable to provide a magnetic cleaning device.

It is also desirable to provide a magnetic cleaning device having magnets mounted on a flexible disc that may be attached or detached from the cleaning device as needed.

It is also desirable to provide a magnetic cleaning device having multiple magnets that may be easily inserted or removed from the flexible disc.

It is also desirable to provide a magnetic cleaning device having magnets disposed close to but not in contact with the inside walls of the pipeline.

It is also desirable to provide a magnetic cleaning device having magnets mounted on a disc that will flex when encountering irregularities in the pipeline.

It is also desirable to provide a magnetic cleaning device having magnets disposed radially with retainer plates for each magnet which secure the magnets in the circular disc.

It is also desirable to provide a magnetic cleaning device having magnets mounted on a flexible disc so that multiple flexible discs may be employed for greater magnetic debris removal.

It is also desirable to provide a flexible disc having magnets therein that may be mounted on existing pipeline cleaning devices.

It is also desirable to provide a magnetic cleaning device wherein the magnets are properly oriented for greater debris drawing and holding capabilities.

It is also desirable to provide a magnetic cleaning device for use along with a pipeline inspection device.

SUMMARY OF THE INVENTION

The present invention provides an improved magnetic cleaning device which is inserted into and passed through a pipeline. The cleaning device includes flexible magnetic disc.

One or more of flexible magnetic discs are disposed on the cleaning device perpendicular to the axis of the pig body.

The magnetic disc also includes a plurality of radially spaced flange attachment openings. Fasteners would pass through the flange attachment openings in the magnetic disc and through corresponding openings in the flanges to secure the magnetic disc to the device.

The edge of the magnetic disc may be close to the interior wall of the pipeline. The disc will flex if it encounters an irregularity or obstruction in the pipeline. Spaced radially inward from the periphery are a series of magnet openings.

Each magnet opening receives a magnet therein so that its magnetic poles will be arranged parallel to the axis of the central shaft or pig body and parallel to the axis of the cylindrical pipeline wall.

Adjacent to each magnet opening are opposed retainer platens or retainer plates. One set of retainer plates are adjacent to the North poles and one set of retainer plates are adjacent to the South poles. Retainer plate fasteners pass through openings in the plates and are received in threaded openings in the magnetic disc.

The opposed retainer plates serve to retain each magnet within the magnetic disc and also serve to extend the magnetic field of action.

The flexible magnetic disc may be readily mounted on and attached to the magnetic cleaning device and also may be readily detached from the cleaning device. A plurality of similar magnetic discs may be inserted and installed on the device.

A series of optional brushes or scrapers may be made a part of the device in order to dislodge loose material therefrom.

Each of the retainer plates is composed of a magnetically permeable material, such as soft steel, so that it forms the pole piece for each magnet.

DETAILED DESCRIPTION OF THE PREFERRED EMBODIMENTS

Figure 1:
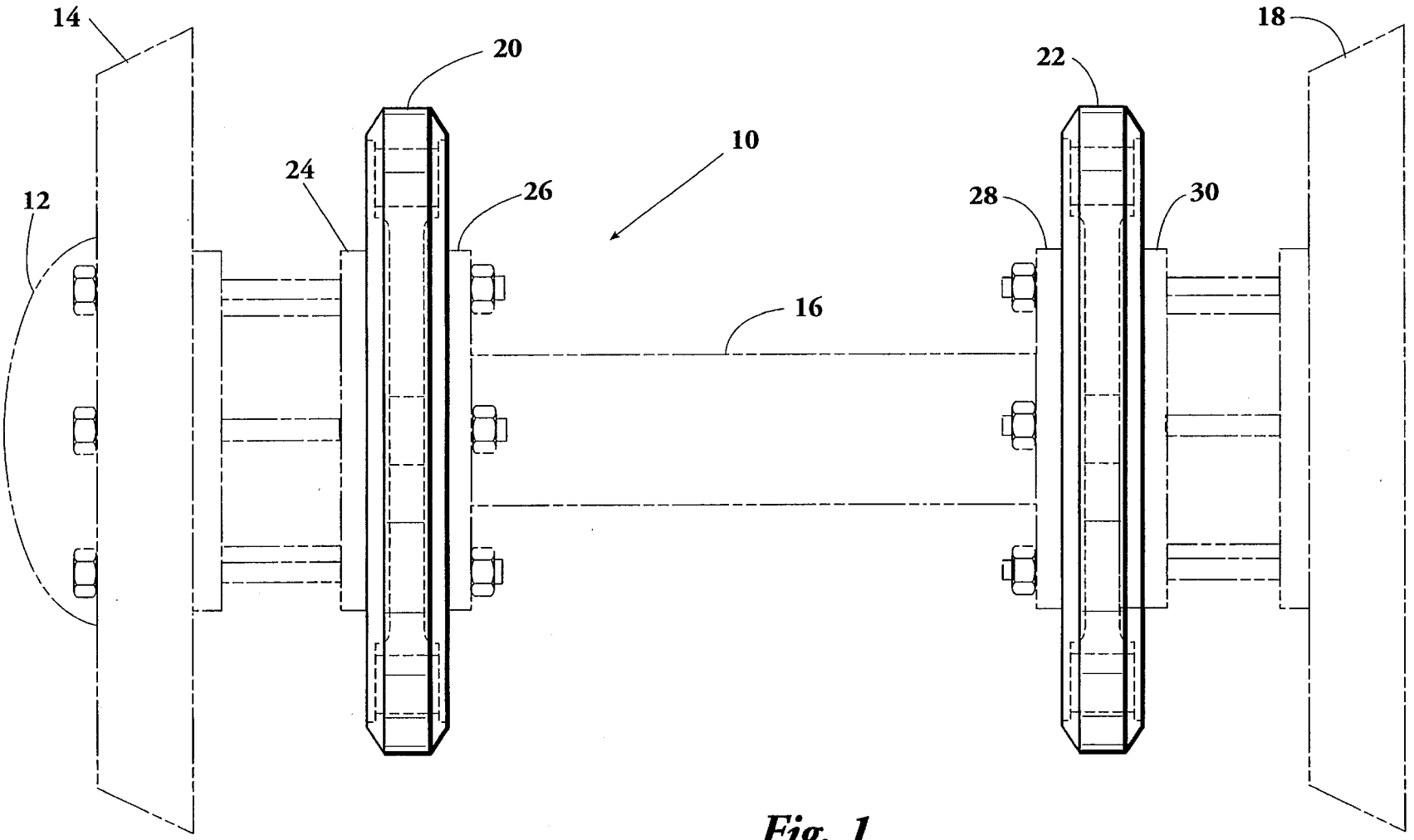
FIG. 1 is a perspective view of a magnetic cleaning device constructed in accordance with the present invention.

Referring to the drawings in detail, FIG. 1 illustrates a magnetic cleaning device 10 which incorporates the teachings of the present invention. Portions of the magnetic device 10 are shown in dashed lines. The device is inserted into and passed through a pipeline having a cylindrical internal wall (not shown). The cleaning device may include a handle 12 used in the event that the cleaning device 10 is pulled through the pipeline.

A first cup or disc 14 is mounted near the front end of the device. The first disc 14 has a circular exterior edge and may be beveled in order to efficiently engage the internal wall of the pipeline. The cup or disc 14 is supported on a pig body 16. A second cup or disc 18 is located near the rear end of the device. The second disc has a circular exterior edge to engage the internal wall of the pipeline. The discs are parallel to each other. Both the first and second discs 14 and 18 are substantially perpendicular to a longitudinal axis of pig body 16.

The cleaning device described to this point is known in the art and may include optional brushes or scrapers (not shown) to dislodge debris from the pipeline.

Between the first disc 14 and the second disc 18 are a pair of flexible magnetic discs 20 and 22. In the present embodiment, the diameter of magnetic discs 20 and 22 is slightly less than the diameter of the discs 14 and 18. A pair of opposed flanges 24 and 26 extend perpendicular to the pig body 16. The flanges 24 and 26 are on opposed sides of the flexible magnetic disc 20. Likewise, a pair of opposed flanges 28 and 30 are on opposed sides of the magnetic disc 22. Opposed flanges 28 and 30 extend perpendicular from the central shaft 16.

Figure 2:
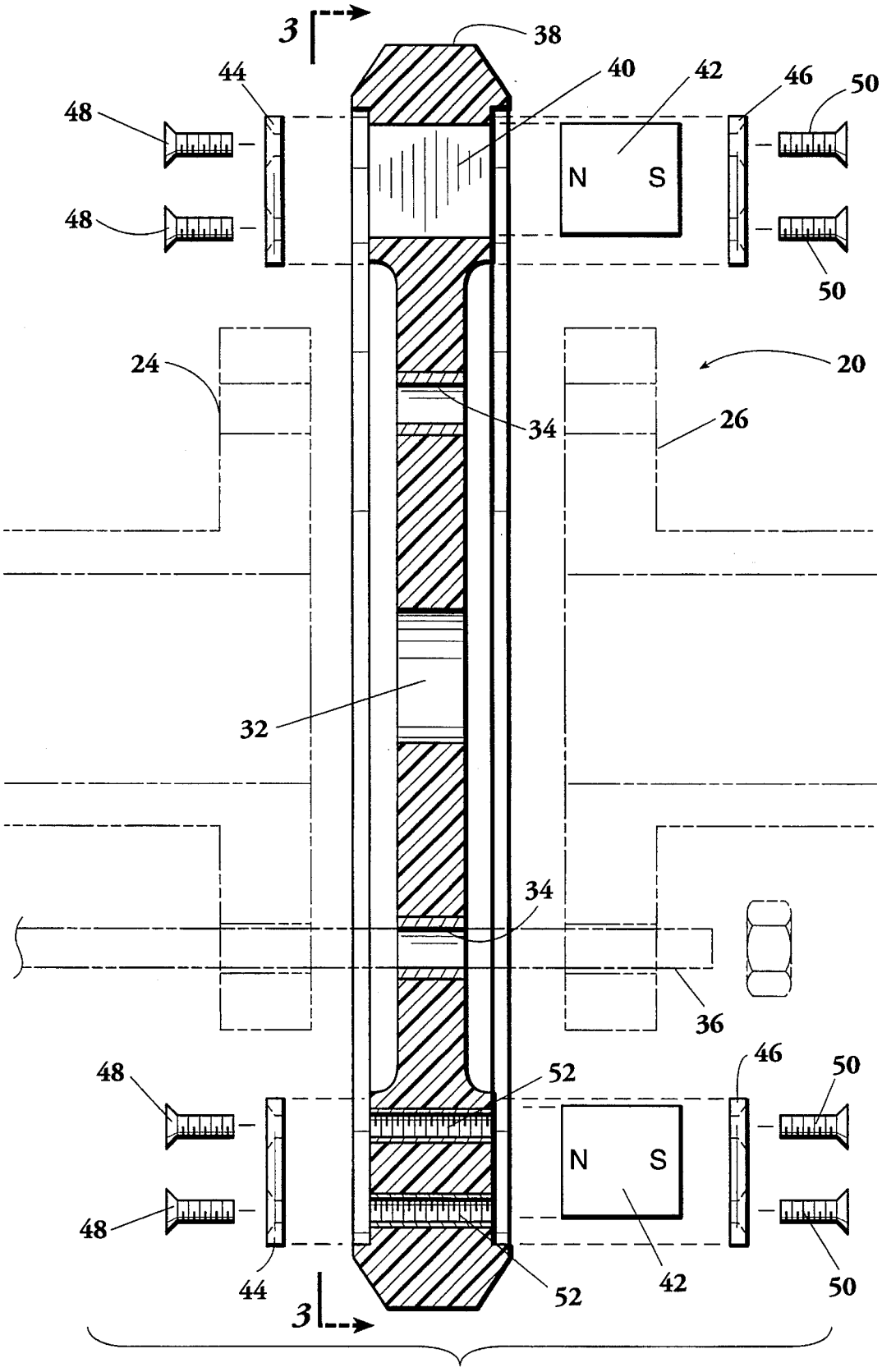
FIG. 2 is a sectional view of a flexible magnetic disc which would be utilized with the magnetic cleaning device showing elements exploded for clarity.

FIG. 2 illustrates a sectional view of the flexible magnetic disc 20. The magnetic disc includes a plurality of radially spaced flange attachment openings 34. Fasteners 36 (shown in dashed lines) would pass through the flange attachment opening 34 in the magnetic disc and through corresponding openings in the flanges 24 and 26 to secure the magnetic disc 20 to the device. With reference to FIG. 1 and continuing reference to FIGS. 2, fasteners 36 also pass through openings in disc 14.

In the present embodiment, the circular edge 38 of the magnetic disc 20 would be close to but not touching the interior wall of the pipeline. The magnetic disc will, thus, not be in constant and ordinary contact with the pipeline. The disc 20 is composed of urethane or other flexible material so that it will flex if it encounters an irregularity or obstruction in the pipeline. The disc 20 will also be constructed of a nonmagnetic material so that it will not interfere with the magnetic fields to be described.

Spaced radially inward from the circular edge 38 are a series of magnet openings 40. In the present embodiment, each opening is equidistant from the center opening.

Each magnet opening 40 receives a magnet 42 therein such as shown expanded from the opening 40 in FIG. 2. In use, each magnet will be inserted and retained in the magnet opening so that its magnetic poles will be arranged parallel to the axis of the pig body 16 and parallel to the axis of the cylindrical pipeline wall. In the present embodiment, the poles of each magnet 42 are also aligned with each other but this alignment is not absolutely necessary. The North (N) and South (S) orientations are shown in FIG. 2.

Adjacent to each opening for each magnet 42 are opposed retainer platens or retainer plates. As seen in the expanded view in FIG. 2, retainer plates 44 are adjacent to the North pole and retainer plates 46 are adjacent to the South pole. Retainer plate fasteners 48 and 50 pass through openings in the plates and retain the magnets within the flexible magnetic disc 20 and are received in threaded openings 52 in the magnetic disc.

The opposed retainer plates 44 and 46 serve to retain each magnet within the magnetic disc 20 and also serve to extend the magnetic field of action.

It will be observed from the foregoing that the flexible magnetic disc 20 may be readily mounted on and attached to the magnetic cleaning device 10 and also may be readily detached from the cleaning device. Likewise, a plurality of similar magnetic discs may be inserted and installed between cups 14 and 18.

It will also be appreciated that magnetic disc 20 or discs may be readily added to existing pipeline devices, including inspection devices. Since the magnetic disc 20 may be added to existing equipment, the present invention also increases the versatility of the equipment.

Optionally, a series of brushes or scrapers (not shown) may be made a part of the device to engage the internal wall of the pipeline in order to dislodge loose material therefrom.

Figure 3:
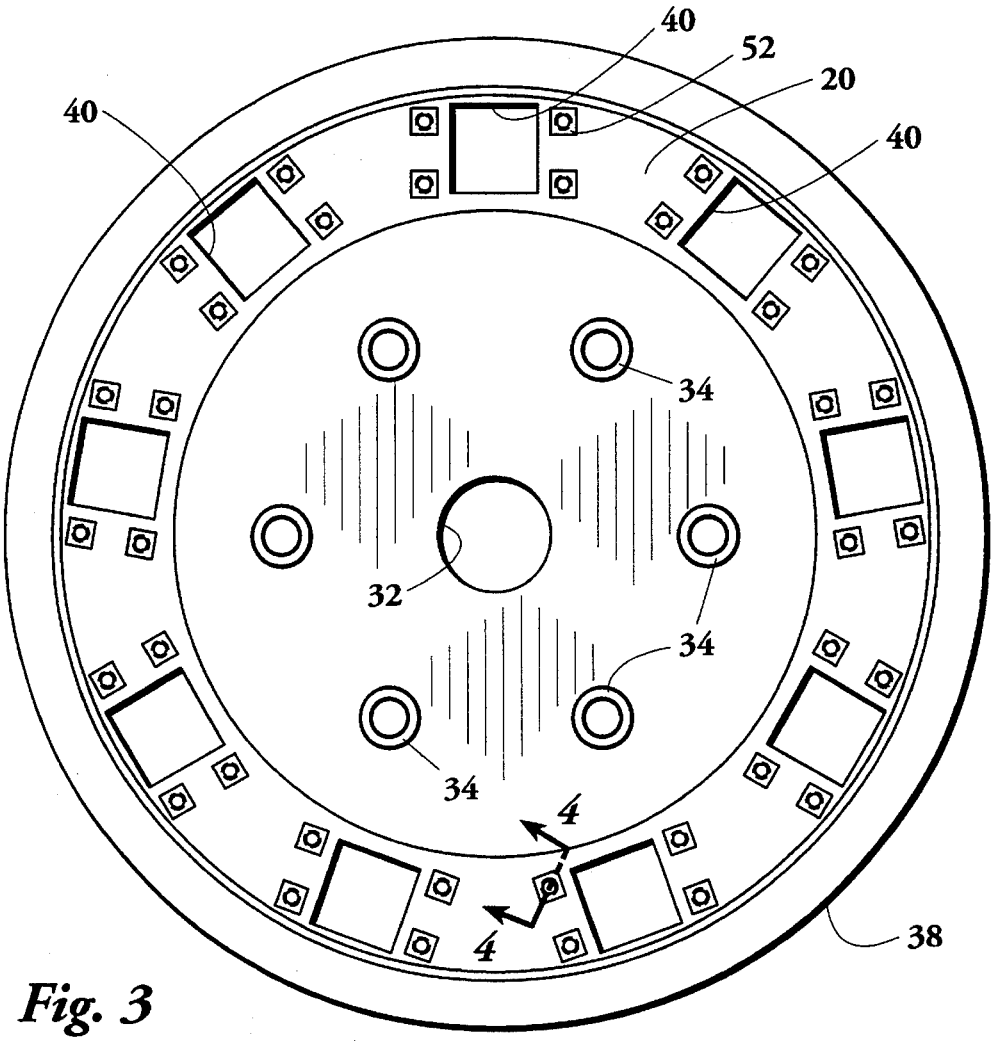
FIG. 3 is a sectional view taken along section line 3—3 of FIG. 2.

FIG. 3 is a sectional view taken along section line 3—3 of FIG. 2. The flexible magnetic disc 20 is shown apart from the other elements. In the embodiment shown, the magnet openings 40 are square shaped to match the shape of the magnets (not shown in FIG. 3). Threaded openings 52 surrounding the magnet openings are visible. In the present embodiment, flange openings 34 are symmetrically arranged around the central opening 32.

Figure 4:
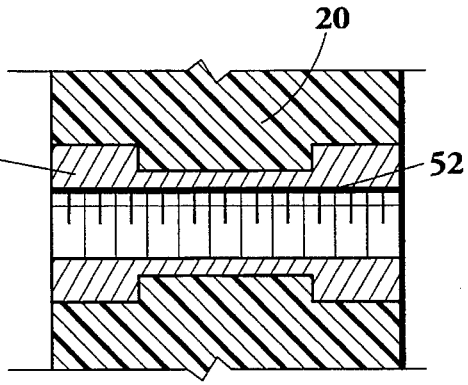
FIG. 4 is a sectional view taken along section line 4—4 of FIG. 3.
Figure 6:
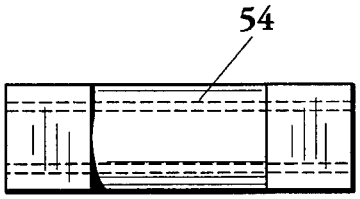
FIGS. 5 and 6 illustrate a threaded receptacle apart from the flexible magnetic disc illustrated in FIG. 3.
Figure 5:
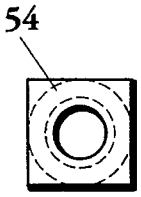

FIG. 4 is a sectional view taken along section line 4—4 of FIG. 3. Threaded opening 52 may be composed from a threaded receptacle 54 as shown in FIGS. 4, 5 and 6.

Figure 7:
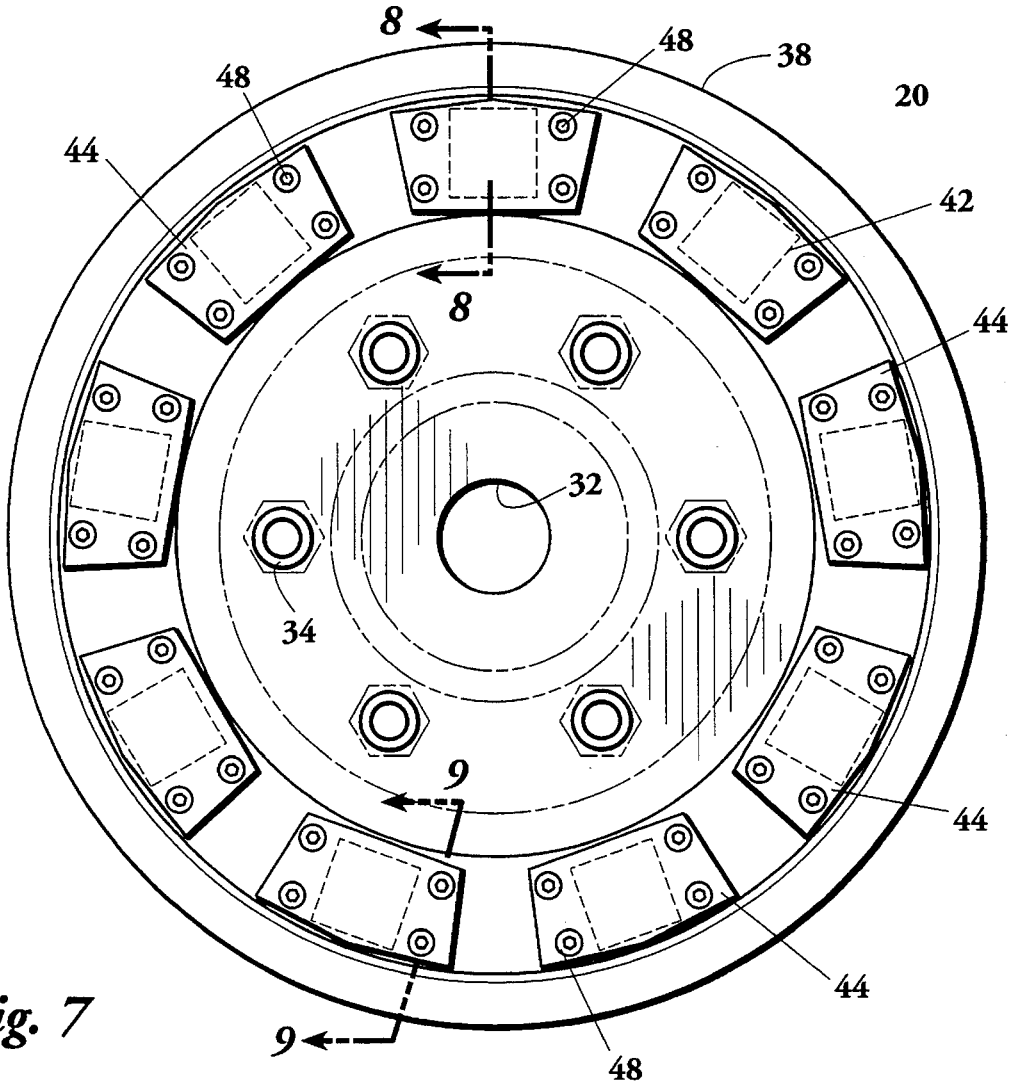
FIG. 7 illustrates a flexible magnetic disc apart from the device.
Figure 8:
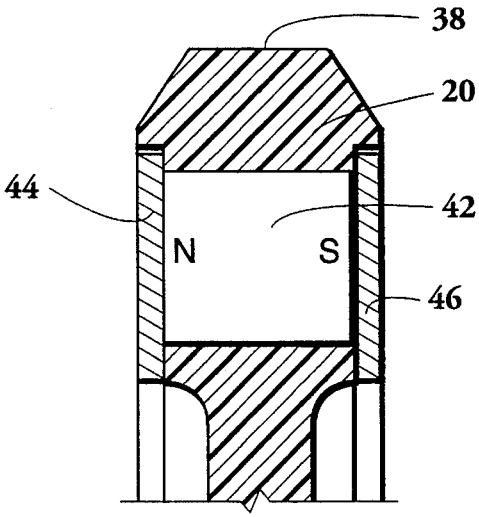
FIG. 8 is a sectional view taken along section line 8—8 of FIG. 7.
Figure 9:
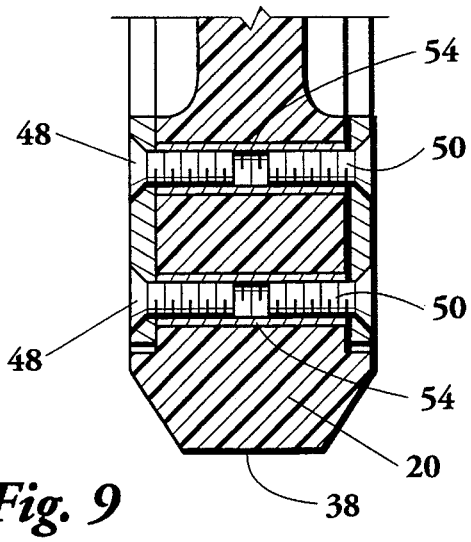
FIG. 9 is a sectional view taken along section line 9—9 of FIG. 7.

FIGS. 7, 8 and 9 illustrate the magnetic disc 20 apart from the cleaning device 10 but with the magnets 42 and retainer plates in place. In the present embodiment, each of the retainer plates 44 is composed of a magnetically permeable material, such as soft steel, so that it forms a pole piece for each magnet. In addition to retaining the magnets in place within the magnetic disc 20, the plates 44 thus serve to extend the magnetic field of action and enhance the retention of ferromagnetic debris.

While a single circular retainer plate may be used on each side of the magnet disc rather than a separate plate for each magnet, the separate plates promote the desired flexibility of the magnetic disc.

As best seen in FIG. 7, in the present embodiment, each retainer plate has a five-sided edge which covers the entire face of the magnet.

FIG. 8 is a sectional view taken along section line 8—8 of FIG. 7. The magnetic plates 44 and 46 are shown flush with the poles of the magnet and retaining the magnet 42 therebetween.

FIG. 9 illustrates a sectional view taken along section line 9—9 of FIG. 7. The retainer plate fasteners 48 and 50 are shown received within the threaded receptacle 54.

The magnetic disc 22 would be constructed identically with magnetic disc 20 described herein and would operate in the same manner.

Whereas, the present invention has been described in relation to the drawings attached hereto, it should be understood that other and further modifications, apart from those shown or suggested herein, may be made within the spirit and scope of this invention.

What is claimed is:

1. A magnetic cleaning device for passing through a pipeline having a cylindrical internal wall, which device comprises:

a. at least one flexible disc body or cup body for engaging said internal wall of said pipeline;

b. at least one flexible magnetic disc perpendicular to said cylindrical wall axis, each said magnetic disc having a plurality of radially spaced openings therethrough;

c. a magnet received in each said opening, said magnets having poles oriented axially with the cylindrical axis of said cylindrical wall;

d. opposed magnetic retainer platens on each side of each said magnet to retain each magnet in said magnet disc and to extend the magnetic field of action; and e. means to fasten said opposed retainer platens to said magnetic disc.

2. A magnetic cleaning device as set forth in claim 1 wherein each said flexible magnetic disc has a generally circular exterior edge.

3. A magnetic cleaning device as set forth in claim 1 wherein said magnetic disc is removable from said magnetic cleaning device.

4. A magnetic cleaning device as set forth in claim 1 including a plurality of said magnetic discs.

5. A magnetic cleaning device as set forth in claim 1 wherein said magnetic disc is positioned between a pair of flanges and secured to said device by fasteners passing through said flanges and through said magnetic disc.

6. A magnetic disc as set forth in claim 1 wherein said magnets are retained by retainer platens.

7. A magnetic disc for a cleaning device which is passed through a pipeline having a cylindrical internal wall, which magnetic disc comprises:

a. a flexible disc body perpendicular to the cylindrical axis of said cylindrical wall, said disc body having a plurality of openings therethrough;

b. a magnet received in each said opening in said disc body, each magnet having poles oriented axially with said cylindrical wall axis;

c. a pair of opposed retainer plates for each said magnet to retain each magnet in said disc body and to extend magnetic fields created by each said magnet; and d. means to fasten said plates to said disc body to retain said magnets in said disc body.

8. A magnetic disc as set forth in claim 7 wherein said disc body is removable from said magnetic cleaning device.

9. A magnetic disc as set forth in claim 7 wherein said means to fasten said plates to said disc body includes fasteners extending through openings in said plates and into receptacles in said disc body.

10. A magnetic disc as set forth in claim 7 wherein said disc body is positioned between a pair of flanges and secured by fasteners passing through said flanges and through said disc body.

11. A magnetic disc as set forth in claim 7 which is alignable with other magnetic discs.

12. A magnetic disc as set forth in claim 7 including a plurality of brushes to engage said cylindrical internal wall of said pipeline.

13. A magnetic disc as set forth in claim 7 wherein said magnets are held in place by retainer platens.

* * * * *